US008627630B2

(12) United States Patent
Oberbroeckling

(10) Patent No.: US 8,627,630 B2
(45) Date of Patent: Jan. 14, 2014

(54) INSERT HOLDING DOOR

(76) Inventor: Philip J. Oberbroeckling, Kingwood, TX (US)

( * ) Notice: Subject to any disclaimer, the term of this patent is extended or adjusted under 35 U.S.C. 154(b) by 0 days.

(21) Appl. No.: 12/756,398

(22) Filed: Apr. 8, 2010

(65) Prior Publication Data

US 2010/0307105 A1 Dec. 9, 2010

Related U.S. Application Data

(63) Continuation-in-part of application No. 12/478,859, filed on Jun. 5, 2009, now abandoned.

(51) Int. Cl.
*E06B 3/70* (2006.01)

(52) U.S. Cl.
USPC .... 52/455; 52/204.51; 52/204.61; 52/204.72; 52/656.5; 52/656.8; 160/90; 49/63; 49/505

(58) Field of Classification Search
USPC ..... 52/656.1, 656.2, 656.4–656.8, 507, 52/45–458; 49/505, 63; 160/90, 91
See application file for complete search history.

(56) References Cited

U.S. PATENT DOCUMENTS

| | | | | | |
|---|---|---|---|---|---|
| 1,207,885 | A | | 12/1916 | Estabrook | |
| 1,370,500 | A | * | 3/1921 | Jones | 160/23.1 |
| 1,573,194 | A | * | 2/1926 | Roe | 160/91 |
| 2,634,146 | A | * | 4/1953 | Johnson | 292/194 |
| 3,414,039 | A | | 12/1968 | King | |
| 4,271,892 | A | | 6/1981 | Brusseau et al. | |
| 4,702,297 | A | * | 10/1987 | Van Klompenburg | 160/271 |
| 5,365,706 | A | | 11/1994 | Elsenpeter et al. | |
| 5,487,243 | A | * | 1/1996 | Hale et al. | 52/202 |
| 5,497,588 | A | * | 3/1996 | Martin et al. | 52/208 |
| 5,901,768 | A | | 5/1999 | Herbst | |
| 5,967,215 | A | * | 10/1999 | Needham et al. | 160/180 |
| 6,161,363 | A | | 12/2000 | Herbst | |
| 6,209,272 | B1 | | 4/2001 | Holzaepfel | |
| 6,233,888 | B1 | * | 5/2001 | Wu | 52/207 |
| 6,250,040 | B1 | | 6/2001 | Green | |
| 6,578,305 | B2 | * | 6/2003 | Lebrun | 40/800 |
| 6,736,534 | B1 | * | 5/2004 | Fite | 362/576 |
| 7,331,617 | B2 | * | 2/2008 | Johnson | 292/202 |
| 7,484,286 | B2 | * | 2/2009 | Fowler | 29/401.1 |
| 7,587,847 | B2 | * | 9/2009 | Lasher | 40/611.01 |

FOREIGN PATENT DOCUMENTS

| | | |
|---|---|---|
| GB | 203017 | 3/1925 |

* cited by examiner

*Primary Examiner* — Chi Q Nguyen
(74) *Attorney, Agent, or Firm* — The Webb Law Firm

(57) ABSTRACT

The present invention is a door with a modular frame which can be installed and removed easily. In several embodiments the door is constructed to fit in a standard interior doorway without modifications to the existing door frame. In several embodiments the opening is constructed in the upper half of the door. In several embodiments the screen is constructed in a modular frame for easy replacement of the screen if damaged or if other material such a glass or acrylic glass is desired in the opening. In several embodiments the modular frame can be replaced without tools. In several embodiments the modular frame could hold a number a different inserts. In several embodiments the door has a regular door panel on one side and an opening with a modular frame on the other side. In several embodiments the door has a self supporting screen.

11 Claims, 5 Drawing Sheets

INSERT HOLDING DOOR

CROSS-REFERENCE TO RELATED APPLICATIONS

This application is related to and claims priority from patent application Ser. No. 12/478,859 filed Jun. 5, 2009 and is herein incorporated by reference.

FIELD OF THE INVENTION

This invention generally pertains to interior doors. More specifically, the present invention relates to an interior door with a replaceable insert in the upper portion and lower portion of the door. In reference to application Ser. No. 12/478,859, one particular type of interior door is a hollow core door. In reference to application Ser. No. 12/478,859, one particular type of insert is a screen.

BACKGROUND OF THE INVENTION

The invention is particularly applicable to interior hollow core doors and will be described with particular reference thereto. However, it will be appreciated by those skilled in the art that the invention has broader applications and may also be adapted for use as an exterior door, tree house door, or other door applications. It will also be appreciated by those skilled in the art that the invention has broader applications such as for particularly applicability to solid core interior doors.

While screen doors have been made of solid core materials, as described in U.S. Pat. No. 6,250,040, none have used hollow core materials. Additionally, none of the screen doors have been designed to fit in a standard home interior 80 inch tall door frame designed to hold a 1&⅜ inch thick door and would require onsite alterations to properly fit and be properly secured in said standard interior doorways. Additionally, no interior door has been designed to accept an array of different inserts that allow the door to have a change in its function nor designed to accept a combination of different inserts to provide a change in the function of the door that differs from the front of the door to the rear of the door. Additionally, no interior door has been designed to be a standard door panel on one side and have the ability for an interchangeable insert to be installed on the other side.

Hollow core doors often consist of a core of lattice or honeycomb made of corrugated cardboard, or thin wooden slats. They can also be built with staggered wooden blocks. The external shell of the door is press-mold fabricated using compressed paper/wood bonded or hard plastic materials or other similar materials allowing for aesthetic designs such as panels. Hollow-core doors are commonly used as interior doors. Compared to solid core doors, they are lighter, cost less to manufacture, durable (scratch resistant) and easier to install.

Accordingly, it has been considered desirable to develop a new and improved hollow core door containing a screen opening (or other translucent inserts such as glass or acrylic glass as alternates) to be used in new construction or as a replacement for an existing interior door which would overcome the foregoing difficulties and others while providing better and more advantageous overall results. Additionally, it has been considered desirable to develop an interior door that has the ability to accept a number of different non-translucent inserts to allow the door to have different functionality without changing the base door.

SUMMARY OF THE INVENTION

The present invention is a door with an opening that has a seat to hold an insert and a modular frame that can be installed and removed easily. In several embodiments the door is constructed to fit in a standard interior doorway without modifications to the existing door frame. In several embodiments the opening is constructed in the upper half of the door. In several embodiments the screen or insert is constructed in a modular frame for easy replacement of the screen if damaged or if other material such a glass, acrylic glass or other insert is desired in the opening. In several embodiments the modular screen frame can be replaced without tools. In several embodiments the modular frame could hold a number a different inserts. For example a screen, a window, a mirror, a poster frame, a picture frame, a poster, a chalk board, a dry erase board, a cork board, or any combination thereof. The modular frame could hold one insert for display on one side of a door and hold another insert for display on the other side of the door.

There are numerous possible uses for the present invention. It is envisioned that the present invention while holding a screen insert could be used as a nursery door to keep unwanted pets or other children from entering the nursery while maintaining an "open" effect of the said room to the home environment. The advantage being that one could still easily hear the infant, and even see the infant but keep unwanted pets away from said infant. The other advantage is that the present invention allows the infant to become acclimated to background noise in the home environment through the "open" effect to develop improved sleeping habits yet is still protected from pets and other children. It is also beneficial to have an easily replaceable screen so that if the screen is damaged by a pet or child it can be quickly replaced. The present invention also has an aesthetically pleasing appearance that has a common pattern matching all other interior doors in a home (house or apartment). Additionally, the present invention fits into the existing interior door frame without alterations allowing for the door to be quickly switched back to the original door when desired. The present invention can be used in a multitude of other applications such as game rooms, TV rooms or computer rooms where viewing of or listening to the activities in the said room is desired. The present invention can be converted into a privacy door when the other types of non-translucent inserts are used allowing the door to be used in child's or teenager's room. The present invention can also have the inserts quickly and easily changed to give the door any number of functional uses in addition to being a door.

OBJECTS OF THE INVENTION

It is, therefore, one of the primary objects of the present invention to provide a door with an opening and a modular frame.

Another object of the present invention is to provide a door with a seat in the opening to hold an insert.

Another object of the present invention is to provide a door that can hold a screen insert.

Another object of the present invention is to provide a door that can hold other types of translucent inserts such as glass or acrylic glass.

Another object of the present invention is to provide a door that can hold many types of non-translucent inserts.

Another object of the present invention is to provide a hollow core door with an opening and a modular frame in the upper half of the door.

Another object of the present invention is to provide a hollow core door with an opening and a modular frame in the lower half of the door.

Still another object of the present invention is to provide a door with a modular frame that can be removed and reattached without the use of tools.

In one embodiment the invention is a door comprising: a hollow core, an opening in said door, a modular frame for installation into said opening, wherein said modular frame is installed into said opening by a plurality of fasteners. In another embodiment said modular frame forms a seat to hold a mesh screen insert. In yet another embodiment said modular frame holds a section of glass. In still yet another embodiment said modular frame holds a section of acrylic glass. In still yet another embodiment said modular frame holds a number of different non-translucent inserts. In yet still another embodiment said plurality of fasteners comprises at least one screw. In yet still another embodiment said plurality of fasteners comprises at least one L-screw. In another embodiment said plurality of fasteners comprises at least one roller latch and at least one clip. In another embodiment said plurality of fasteners comprises at least one spring latch and at least one clip. In another embodiment said plurality of fasteners comprises at least one roller latch, at least one clip, and at least one pin. In another embodiment said plurality of fasteners comprises at least one roller latch, at least one clip, at least one screw and at least one pin. In another embodiment said plurality of fasteners comprises at least one tab. In another embodiment said plurality of fasteners comprises at least one slot. In another embodiment said plurality of fasteners comprises at least one spring. In another embodiment said plurality of fasteners comprises at least one tab, at least one slot, and at least one screw. In another embodiment said plurality of fasteners comprises at least one tab, at least one slot, and at least one spring. In another embodiment said plurality of fasteners comprises at least one tab, at least one slot, at least one screw and at least one spring. In another embodiment said modular frame is installed into said opening without tools where the said mesh screen insert is placed into said opening. In another embodiment said modular frame is installed into said opening without tools where the said non-translucent insert is placed into said opening. In yet still another embodiment said opening in said door is located in the upper half portion of said door. In yet still another embodiment said opening in said door is located in the lower half portion of said door.

In another example embodiment the invention is a hollow core door comprising: an opening in said hollow core door, a modular mesh screen frame for installation into said opening, wherein said modular mesh screen frame is installed into said opening by a plurality of fasteners. In another embodiment said plurality of fasteners comprises at least one L-screw. In yet another embodiment said plurality of fasteners comprises at least one roller latch and at least one clip. In still another embodiment said plurality of fasteners comprises at least one roller latch, at least one clip, and at least one pin. In yet still another embodiment said plurality of fasteners comprises at least one roller latch, at least one clip, at least one screw and at least one pin. In yet still another embodiment said plurality of fasteners comprises at least one spring, and at least one groove. In still yet another embodiment said modular mesh screen frame is installed into said opening without tools by placing said modular mesh screen frame into said opening. In yet still another embodiment said opening in said door is located in upper half portion of said door. In yet still another embodiment said opening in said door is located in the lower half portion of said door.

In another example embodiment the invention is a door comprising: a hollow core, an opening in said door on one side of the door, a regular door panel on the said door on the other side of the door, a modular frame for installation into said opening, wherein said modular frame is installed into said opening by a plurality of fasteners. In another embodiment said modular frame forms a seat to hold an array of different non-translucent inserts. In yet still another embodiment said plurality of fasteners comprises at least one screw. In yet still another embodiment said plurality of fasteners comprises at least one L-screw. In another embodiment said plurality of fasteners comprises at least one roller latch and at least one clip. In another embodiment said plurality of fasteners comprises at least one spring latch and at least one clip. In another embodiment said plurality of fasteners comprises at least one roller latch, at least one clip, and at least one pin. In another embodiment said plurality of fasteners comprises at least one roller latch, at least one clip, at least one screw and at least one pin. In another embodiment said plurality of fasteners comprises at least one tab. In another embodiment said plurality of fasteners comprises at least one slot. In another embodiment said plurality of fasteners comprises at least one spring. In another embodiment said plurality of fasteners comprises at least one tab, at least one slot, and at least one screw. In another embodiment said plurality of fasteners comprises at least one tab, at least one slot, and at least one spring. In another embodiment said plurality of fasteners comprises at least one tab, at least one slot, at least one screw and at least one spring. In another embodiment said modular frame is installed into said opening without tools where the said non-translucent insert is placed into said opening. In yet still another embodiment said opening in said door is located in the upper half portion of said door. In yet still another embodiment said opening in said door is located in the lower half portion of said door.

In another example embodiment the invention is a door comprising: a solid core, an opening in said door, a modular frame for installation into said opening, wherein said modular frame is installed into said opening by a plurality of fasteners. In another embodiment said modular frame forms a seat to hold a mesh screen insert. In yet another embodiment said modular frame holds a translucent insert such as glass or acrylic glass. In still yet another embodiment said modular frame holds a number of different non-translucent inserts. In yet still another embodiment said plurality of fasteners comprises at least one screw. In yet still another embodiment said plurality of fasteners comprises at least one L-screw. In another embodiment said plurality of fasteners comprises at least one roller latch and at least one clip. In another embodiment said plurality of fasteners comprises at least one spring latch and at least one clip. In another embodiment said plurality of fasteners comprises at least one roller latch, at least one clip, and at least one pin. In another embodiment said plurality of fasteners comprises at least one roller latch, at least one clip, at least one screw and at least one pin. In another embodiment said plurality of fasteners comprises at least one tab. In another embodiment said plurality of fasteners comprises at least one slot. In another embodiment said plurality of fasteners comprises at least one spring. In another embodiment said plurality of fasteners comprises at least one tab, at least one slot, and at least one screw. In another embodiment said plurality of fasteners comprises at least one tab, at least one slot, and at least one spring. In another embodiment said plurality of fasteners comprises at least one tab, at least one slot, at least one screw and at least one spring. In another embodiment said modular frame is installed into said opening without tools where the said mesh screen insert is placed into said opening. In another embodiment said modular frame is installed into said opening without tools where the said translucent insert is placed into said opening.

In another embodiment said modular frame is installed into said opening without tools where the said non-translucent insert is placed into said opening. In yet still another embodiment said opening in said door is located in the upper half portion of said door. In yet still another embodiment said opening in said door is located in the lower half portion of said door.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention; and together with the description serve to explain the principles and operation of the invention.

Figure 1:
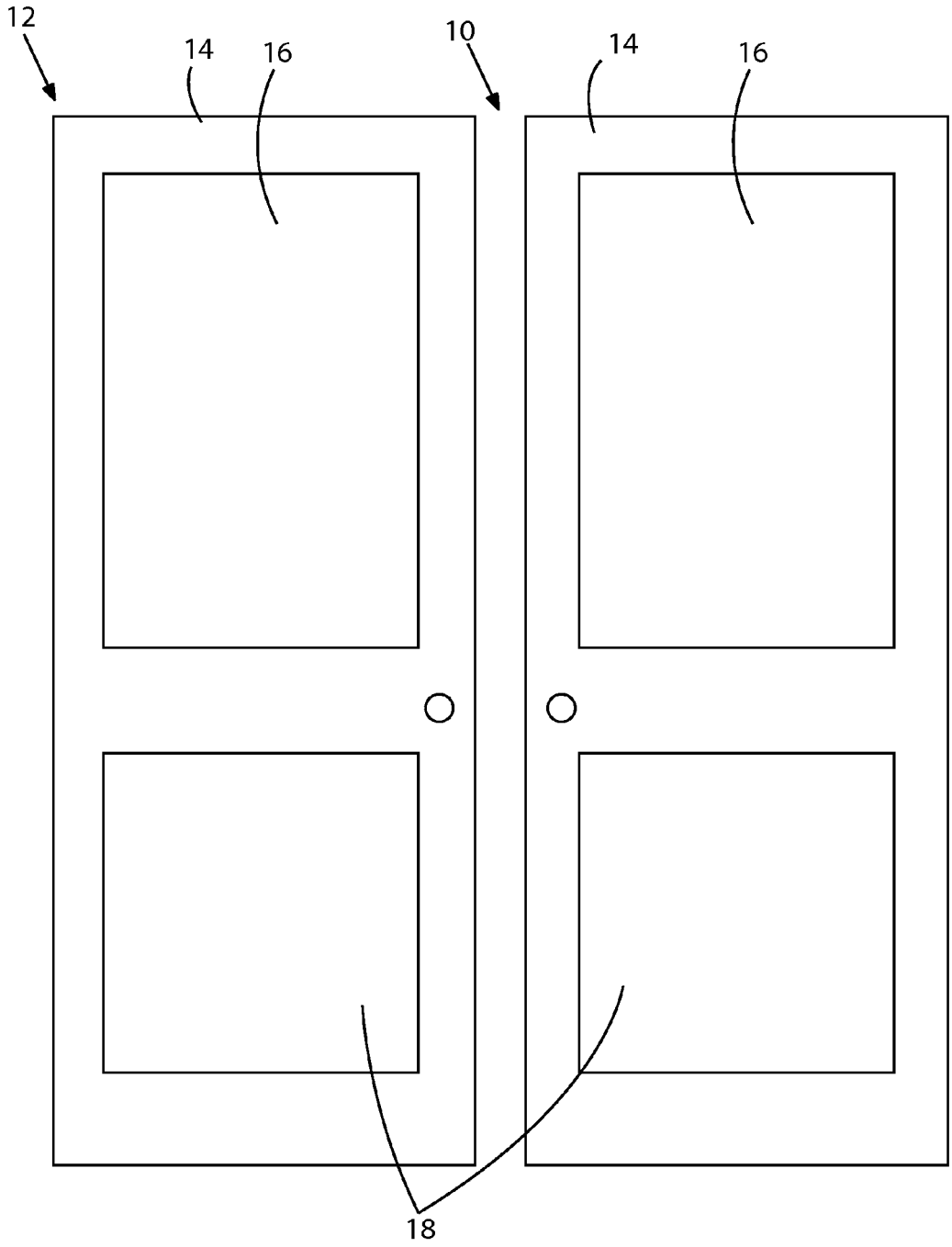
FIG. 1 is a simplified front and rear view of the door, without inserts installed, of one embodiment of the present invention.

DETAILED DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 4:
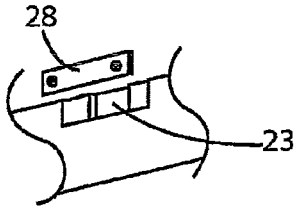
FIG. 4 is a detailed view of one embodiment of a lower slot.
Figure 5:
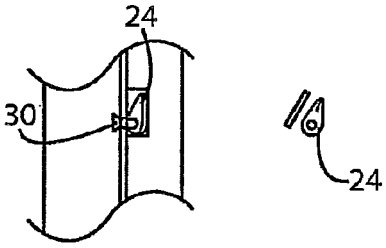
FIG. 5 is a detailed view of one embodiment of a security tab.
Figure 6:
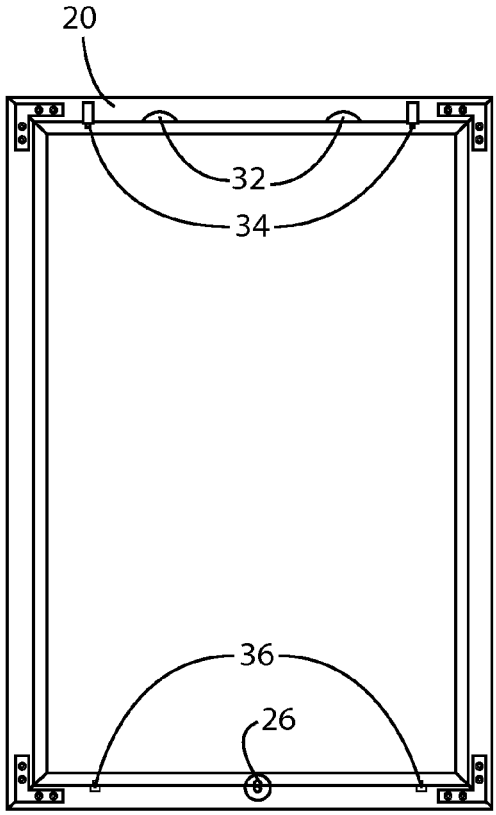
FIG. 6 is a detailed view of one embodiment of a modular frame.

Reference is now made to FIGS. 1-9, more particularly, to FIG. 1 which is a simplified front view 10 and rear view 12 of the door, without inserts installed, of one embodiment of the present invention. Hollow core door 14 also comprises top opening 16 and bottom opening 18 for accepting a modular frame 20(a preferred embodiment is shown in FIG. 6). The hollow core door could comprise one or both openings depending on user preference.

Figure 2:
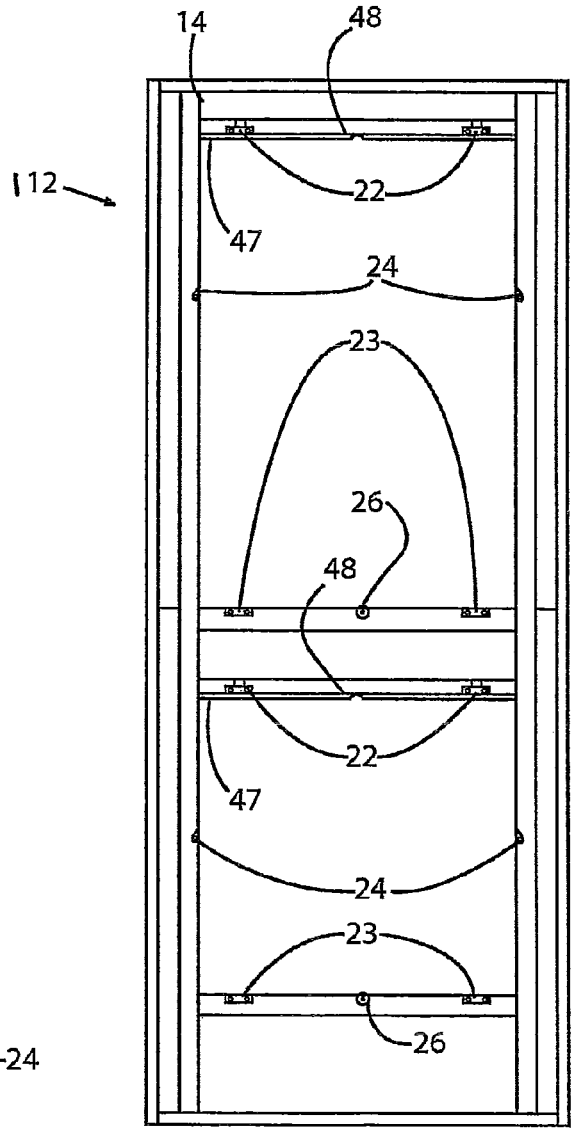
FIG. 2 is an internal view of the door, without inserts installed, of one embodiment of the present invention.

Particular reference is now made to FIG. 2 which is a detailed internal view 112 of the hollow core door 14, without inserts installed, of one embodiment of the present invention. Top opening 16 and bottom opening 18 each comprise upper slots 22, lower slots 23, security tabs 24, slide ridge 47, finger tab 48 and safety screws 26. It is important to note that when the hollow core door only comprises of the upper opening, the bottom internal framework for the opening may not be present.

Figure 3:
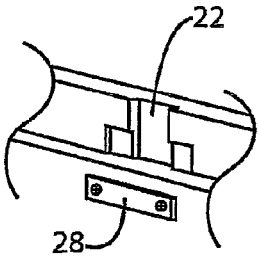
FIG. 3 is a detailed view of one embodiment of an upper slot.

Particular reference is now made to FIG. 3 which is a detailed view of one embodiment of an upper slot. Upper slot 22 is partially enclosed by metal plate 28 which is secured by screws.

Particular reference is now made to FIG. 4 which is a detailed view of one embodiment of a lower slot. Lower slot 23 is partially enclosed by metal plate 28 which is secured by screws.

Particular reference is now made to FIG. 5 which is a detailed view of one embodiment of a security tab. Security tab 24 is secured by a spring assembly 30 which comprises a spring and a screw.

Particular reference is now made to FIG. 6 which is a detailed view of one embodiment of a modular frame. The view shown here is of the rear or mating side of the modular frame 20. Modular frame 20 comprises tension springs 32, upper support tabs 34, lower support tabs 36 and safety screw 26. The frame can be fabricated using a multitude of materials such as: wood, plastic, fiberglass, metal, fiberglass re-enforced wood or plastic, and metal re-enforced wood or plastic.

Figure 7:
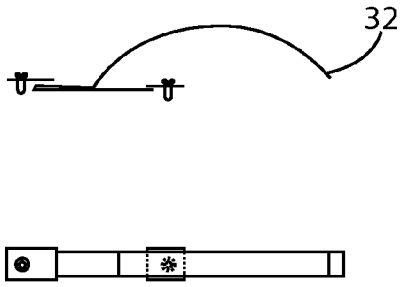
FIG. 7 is a detailed view of one embodiment of a tension spring.

Particular reference is now made to FIG. 7 which is a detailed view of one embodiment of a tension spring. Tension spring 32 may be a standard side tension spring as used with many exterior window screens. Tension spring 32 is preferably secured to modular frame 20 by means of screws or other fasteners.

Figure 8:
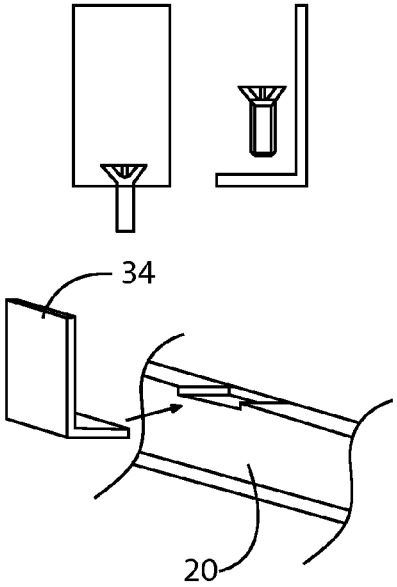
FIG. 8 is a detailed view of one embodiment of an upper support tab.

Particular reference is now made to FIG. 8 which is a detailed view of one embodiment of an upper support tab. Upper support tab 34 is shown being installed into modular frame 20 by means of a screw. The tab can be attached using alternative methods.

Figure 9:
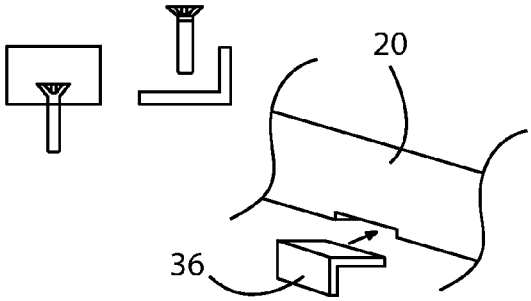
FIG. 9 is a detailed view of one embodiment of a lower support tab.

Particular reference is now made to FIG. 9 which is a detailed view of one embodiment of a lower support tab. Lower support tab 36 is shown being installed into modular frame 20 by means of a screw. The tab can be attached using alternative methods.

Reference is now made to FIGS. 1-9, modular frame 20 and hollow core door 14 may have felt, foam, rubber or similar material lining the surfaces that contact each other when installing or replacing the modular frame. The material lining theses surface would help prevent or reduce rattling, vibration noise, and drafts among other benefits.

Figure 10:
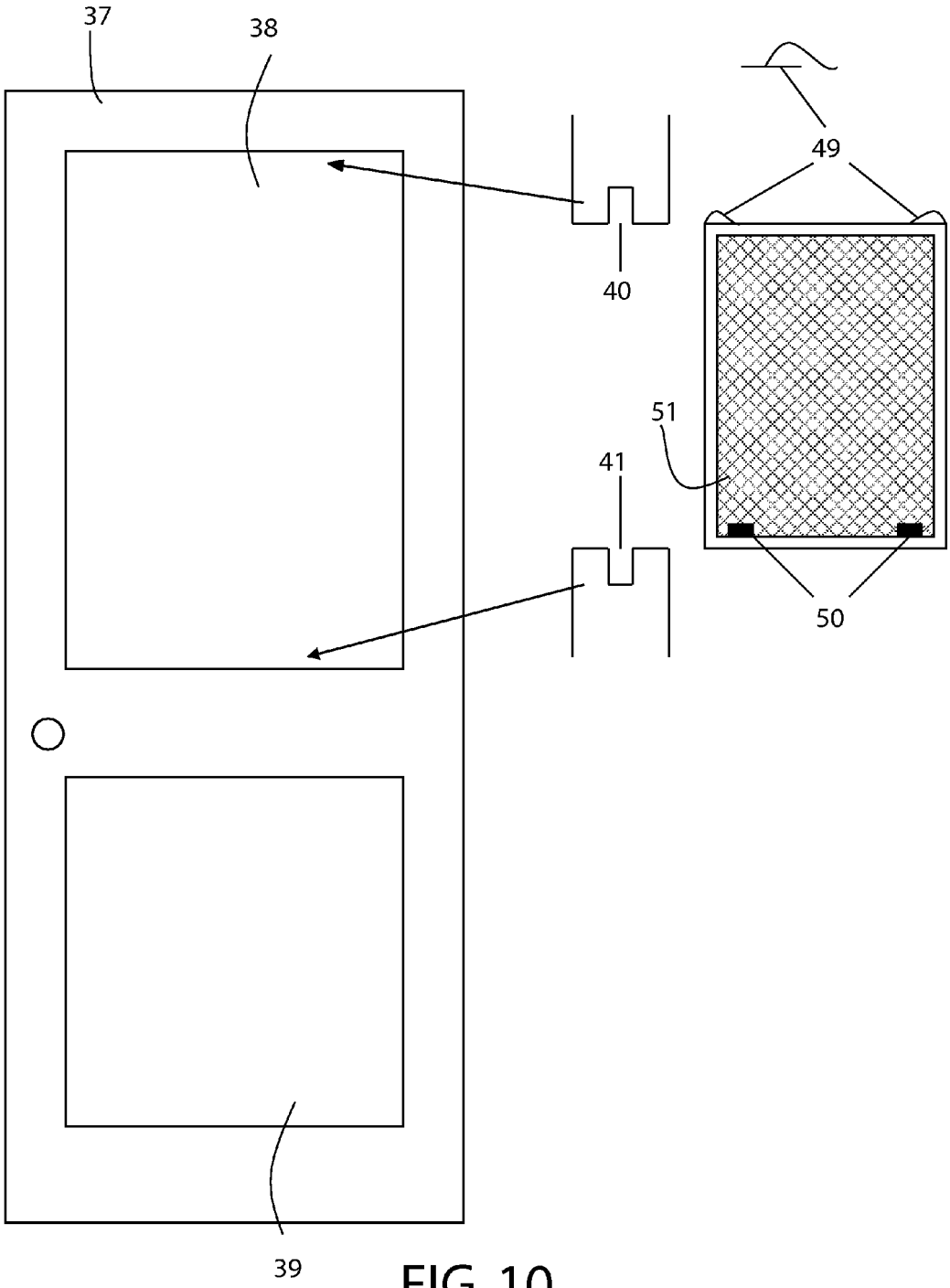
FIG. 10 is a detailed view of one embodiment of an alternative self supporting screen.

Reference is now made to FIG. 10, which is a simplified front view of the door 37, without inserts installed, having an optional method for holding the screen of one embodiment of the present invention. Door 37 has an opening 38 on the top half of the door and an opening 39 on the bottom half of the door. The top of an opening has a groove 40 and the bottom of an opening has a groove 41 for accepting the screen frame 51. The screen frame 51 has tension springs on top 49 as used with many exterior window screens and pull tabs 50 on the bottom. This is an optional design for the Hollow Core Screen Door.

Figure 11:
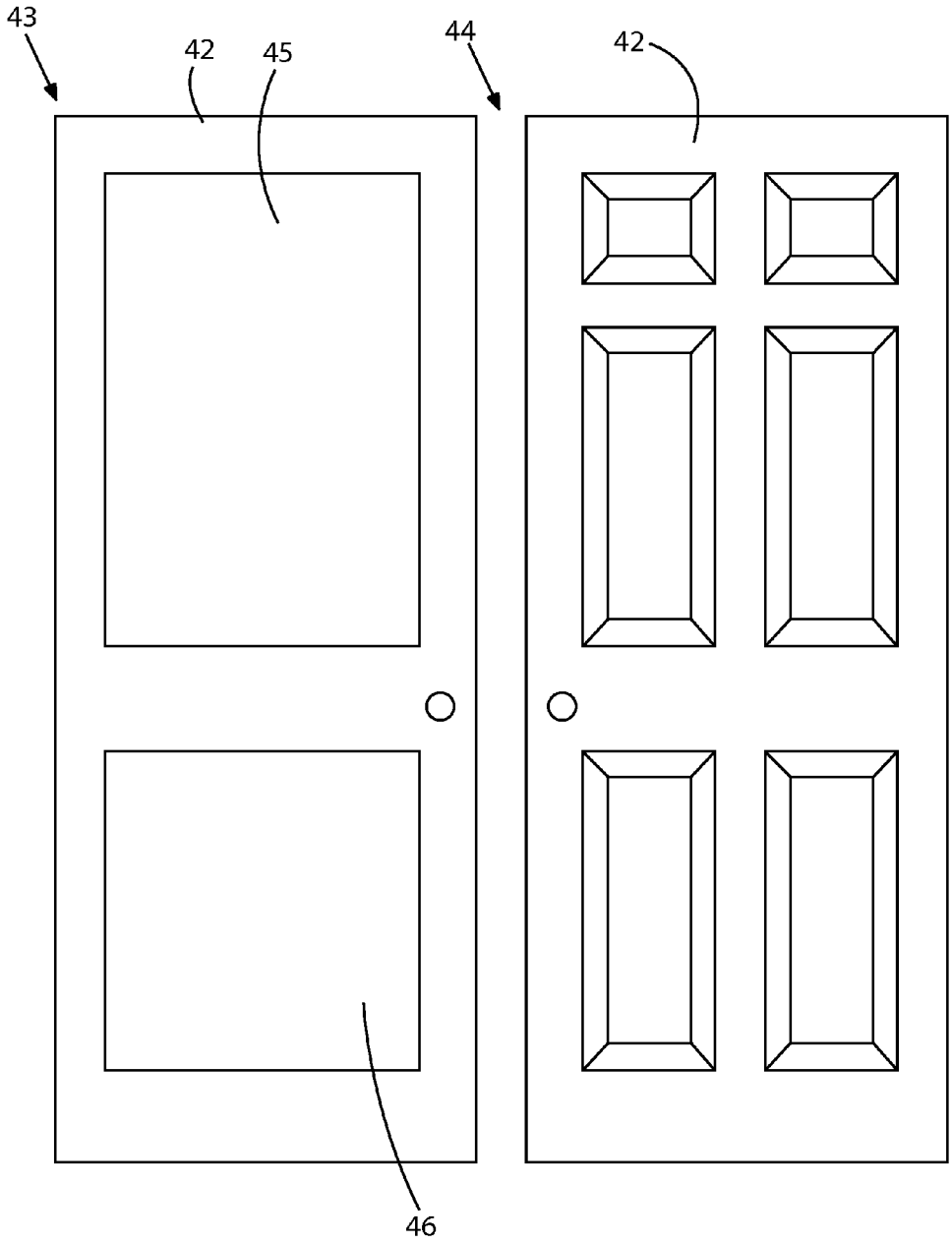
FIG. 11 is a simplified front and rear view of an alternative door configuration where the front view has the insert seat and modular frame and the rear view is a regular door panel, without inserts installed, of one embodiment of the present invention.

Reference is now made to FIG. 11, which is a simplified rear view 43 and front view 44 of the door, without inserts installed, of one embodiment of the present invention. Hollow core door 42 comprises a paneled front side shown in front view 44. Hollow core door 42 also comprises a top opening 45 and bottom opening 46 on the rear view 43 of the door 42 for accepting a modular frame 20(a preferred embodiment is shown in FIG. 6). The door could comprise one or both openings depending on user preference. This is an optional design for the present invention.

While a presently preferred and various alternative embodiments of the present invention have been described in sufficient detail above to enable a person skilled in the relevant art to make and use the same, it should be obvious that various other adaptations and modifications can be envisioned by those persons skilled in such art without departing from either the spirit of the invention or the scope of the appended claims.

What is claimed:

1. An insert holding system comprising:

an opening being defined through a panel, said opening having a front open end and a back open end, forming a seat about a perimeter of the opening proximal to one of the front open end and the back open end, the opening including at least one stationary upper slot, at least one stationary lower slot, and a slide ridge at the top of the opening to form a movement space, a removable modular frame for installation into said opening, said modular frame includes at least one spring, at least one stationary upper tab and at least one stationary lower tab, a raised internal surface about the perimeter of said modular frame and an outer perimeter surface larger than the said front open end in the said panel, wherein the perimeter of the opening forming the seat proximal to one of the front open end and the back open end is lined with a compressible material, wherein the raised internal surface about the perimeter of said modular frame is lined with the compressible material, wherein said modular frame is installed into said opening at least in part by securing said at least one stationary upper tab into said at least one stationary upper slot by applying an upward movement of the said modular frame, pushing the upper portion of the said raised surface of the frame into the said open space of the said slide ridge and securing said at least one stationary lower tab into said at least one stationary lower slot, applying a combination of a pivoting inward movement to the bottom of the said modular frame where pressure is applied followed by a downward movement of the modular frame moving the upper raised surface of the said modular frame out of the said slide ridge, thereby aligning the internal edge of the entire raised perimeter of the said modular frame with the entirety of the edge of the said inset ridge, wherein said modular frame is removed from said opening at least in part by applying a combination of movements, first applying an upward movement of the entire said modular frame to a height sufficient to release the said at least one lower stationary tab from the said at least one stationary lower slot pushing the said upper raised surface of the said frame into the said slide ridge then applying an outward pivoting movement of the bottom of the said modular frame as to have the raised ridge of the said frame overcome the edge of the said opening followed by a downward movement of the entire said frame sufficient to release the said at least one upper stationary tab from the said at least one stationary upper slot, wherein said raised internal surface of the frame applies pressure against the perimeter of the insert which then compresses the insert against the seat of the opening compressing the compressible material therebetween, wherein said modular frame stationary tabs slide in and out of the stationary slots to allow installation and removal of the frame and insert without the use of tools, wherein said modular frame is secured in place by a sliding movement perpendicular to the applied compression on the insert, wherein the stationary tabs on said modular frame are reinforced into the stationary slots by opposite counter force in the removal direction of the stationary tabs from the stationary slots by said at least one spring, wherein said raised internal surface of the modular frame aligns with the slide ridge of the opening when seated, wherein the outer perimeter of the said modular frame rests flush with the panel surface when seated, wherein said modular frame covers and hides from view said at least one stationary upper slot, said at least one stationary lower slot, said at least one spring, said at least one upper stationary tab, said at least one lower stationary tab and said slide ridge.

2. The insert holding system of claim 1, wherein said modular frame holds a mesh screen as an insert.

3. The insert holding system of claim 1, wherein said modular frame holds a non-translucent insert, chosen from a group comprising a mirror, a poster frame, a picture frame, a poster, a chalk board, a dry erase board, a cork board, or any combination thereof.

4. The insert holding system of claim 1, wherein said modular frame holds a section of translucent material.

5. The insert holding system of claim 1, wherein said modular frame holds a section of transparent material.

6. The insert holding system of claim 1, further comprising at least one slot formed by a metal plate.

7. The insert holding system of claim 1, wherein said opening is disposed in a door.

8. The insert holding system of claim 1, wherein said modular frame is installed into said opening without tools by placing said modular frame into said opening, and wherein said modular frame is uninstalled from said opening without tools by pulling said modular frame.

9. The insert holding system of claim 1, wherein said opening is disposed in a hollow core door comprising:

a regular hollow core door panel on a first side, a opening in said hollow core door panel on a second side, and wherein the opening in the second side is configured to receive said modular frame forming a one-sided insert holding door.

10. The insert holding system of claim 9, wherein said modular frame holds a non-translucent insert.

11. The insert holding system of claim 9, wherein said modular frame holds a section of translucent material.

* * * * *